US008852833B2

(12) United States Patent
McGuire et al.

(10) Patent No.: US 8,852,833 B2
(45) Date of Patent: Oct. 7, 2014

(54) IMAGING MEMBER AND METHOD OF MAKING AN IMAGING MEMBER

(75) Inventors: Gregory McGuire, Oakville (CA); Richard Klenkler, Oakville (CA); Yvan Gagnon, Mississauga (CA); Yu Liu, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 54 days.

(21) Appl. No.: 13/458,562

(22) Filed: Apr. 27, 2012

(65) Prior Publication Data

US 2013/0288168 A1 Oct. 31, 2013

(51) Int. Cl.
*G03G 15/04* (2006.01)
*G03G 15/00* (2006.01)

(52) U.S. Cl.
USPC ..... 430/66; 430/58.75; 399/116; 399/159

(58) Field of Classification Search
USPC ..... 430/58.75, 66; 399/116, 119, 159
See application file for complete search history.

(56) References Cited

U.S. PATENT DOCUMENTS

| | | | |
|---|---|---|---|
| 3,121,006 | A | 2/1964 | Middleton et al. |
| 4,286,033 | A | 8/1981 | Neyhart et al. |
| 4,291,110 | A | 9/1981 | Lee |
| 4,338,387 | A | 7/1982 | Hewitt |
| 4,464,450 | A | 8/1984 | Teuscher |
| 4,587,189 | A | 5/1986 | Hor et al. |
| 4,664,995 | A | 5/1987 | Horgan et al. |
| 4,921,773 | A | 5/1990 | Melnyk et al. |
| 5,069,993 | A | 12/1991 | Robinette et al. |
| 5,547,759 | A | 8/1996 | Chen et al. |
| 5,649,273 | A | 7/1997 | Shimizu et al. |
| 5,756,245 | A | 5/1998 | Esteghamatian et al. |
| 5,846,643 | A | 12/1998 | Badesha et al. |
| 6,668,152 | B1 | 12/2003 | Jacob |
| 6,927,006 | B2 | 8/2005 | Finn et al. |
| 7,441,745 | B2 | 10/2008 | Kawaguchi et al. |
| 7,553,594 | B2 | 6/2009 | Ogaki et al. |
| 7,838,190 | B2 | 11/2010 | Ogaki et al. |
| 7,939,230 | B2 | 5/2011 | Kim et al. |
| 2007/0031639 | A1 | 2/2007 | Hsu et al. |
| 2009/0010664 | A1* | 1/2009 | Nukada et al. ..... 399/49 |
| 2009/0016790 | A1 | 1/2009 | Funabiki |
| 2010/0015539 | A1* | 1/2010 | Qi et al. ..... 430/58.05 |
| 2011/0014563 | A1 | 1/2011 | Kim et al. |
| 2011/0183114 | A1 | 7/2011 | Kim et al. |
| 2011/0183265 | A1 | 7/2011 | Kim et al. |

OTHER PUBLICATIONS

Hu et al., U.S. Appl. No. 13/162,371, filed Jun. 16, 2011, entitled "Methods and Systems for Making Patterned Photoreceptor Outer Layer."

* cited by examiner

*Primary Examiner* — Thorl Chea
(74) *Attorney, Agent, or Firm* — MH2 Technology Law Group LLP

(57) ABSTRACT

Imaging members having a support, an imaging layer disposed on the support, an outer layer disposed on the imaging layer and fluoropolymer particles imbedded in an outer surface of the outer layer. Image forming apparatuses having such imaging members. Processes for preparing an imaging member for an electrophotographic apparatus, the process involving coating an imaging layer with an outer layer formulation. The imaging layer can be disposed on a support. The outer layer formulation can be dried to form an outer layer disposed on the imaging layer and has an outer surface. Fluoropolymer particles are applied to the outer layer.

18 Claims, 6 Drawing Sheets

IMAGING MEMBER AND METHOD OF MAKING AN IMAGING MEMBER

BACKGROUND

Embodiments herein relates generally to imaging apparatus members and components for use in electrophotographic apparatuses. Some embodiments are drawn to improved electrophotographic imaging members comprising an outer layer having a surface layer wherein particles of PTFE are imbedded in or bonded to the surface layer. Some embodiments also pertain to methods for making such imaging members/components.

In electrophotographic printing, the charge retentive surface, known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image can then be transferred to a substrate (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface can be imagewise discharged in a variety of ways.

The described electrophotographic copying process is well known and is commonly used for light lens copying of an original document. Analogous processes also exist in other electrophotographic printing applications such as, for example, digital laser printing or ionographic printing and reproduction where charge is deposited on a charge retentive surface in response to electronically generated or stored images.

Multilayered photoreceptors or imaging members have at least two layers, and can include a support, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form, a cylinder configuration or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members can include an anti-curl layer on the backside of the support, opposite to the side of the electrically active layers, to render the desired photoreceptor flatness.

Long life photoreceptors can result in significant run-cost reductions. Development of long life photoreceptors has included the development of low wear protective overcoat layers. These layers help facilitate dramatically reduced surface wear. However, these layers also often introduce a host of unwanted issues caused by the poor interaction between the cleaning blade and the overcoat layer. The overcoats can be associated with extremely high initial torque and can result in print defects, poor cleaning, cleaning blade damage/failure and cleaning blade flip, and, in some cases, the high initial torque can prevent the drum from turning and can cause a motor fault.

Interactions between the photoreceptor drum surface and contacting xerographic components, such as a cleaning blade, can result in a number of failure modes which have a direct impact on image quality and printer operation. If the torque exceeds the limits of the drive motor there will be a forced shutdown of the printer. High torque can also induce mechanical stress and vibration in the cleaning blade, which can be manifested as deformation and acoustic squeaking of the blade. This can reduce the cleaning efficiency of the blade and can even damage the blade surface enough to permit permanent toner contamination of the photoreceptor. The contamination is often characterized by lines of toner around the circumference of the photoreceptor drum and register with the damaged areas of the cleaning blade.

A first approach to addressing these issues has focused on material changes to the overcoat to improve, the interaction (e.g., reduce friction) between the cleaning blade and the overcoat. Examples of such material changes include the addition of low surface energy additives, lubricating oils, capsules containing lubricating oils, and healing materials to reduce the friction. These solutions have shown some success, but also introduce other issues such as oil contamination of customer replaceable units (CRUs, such as toner cartridges, cleaning webs, and toner and developer waste containers, among others), transient benefit, or increased lateral charge migration (LCM).

A second approach has been to change the surface morphology via patterning of the overcoat layer surface. This second approach has faced obstacles in that creating a permanent pattern on the overcoat layers can often be difficult as the pattern tends to be transient during the manufacturing process.

It would be desirable to provide long life photoreceptors that overcome the problems resulting from severe initial torque associated with low wear overcoats and that would enable blade conformation to the overcoat layer of the photoreceptor during initial cycling.

SUMMARY

Some embodiments herein are drawn to imaging members comprising: a support, an imaging layer disposed on the support, an outer layer disposed on the imaging layer, wherein the outer layer has an outer surface and fluoropolymer particles that are imbedded in and/or bonded to the outer surface of the outer layer.

Certain embodiments herein are drawn to an imaging member (e.g., photoreceptor) comprising PTFE particles imbedded in the outer layer (i.e., the outer surface of the outer layer) of the imaging member. Some embodiments herein can overcome severe initial torque associated with low wear overcoats and/or can enable blade conformation to an overcoat/outer layer of an imaging member during initial cycling. The PTFE particles can be worn away after about 5,000 to about 10,000 prints and the imaging member can remain free of problems associated with severe torque.

Torque can be measured on a torque fixture comprising a standard production print cartridge, which consists of a photoreceptor drum, a bias charge roller (BCR), a developer station and a cleaning blade. The bottom portion of the cartridge having a fresh toner compartment and the top portion having a waste toner compartment. An aperture in the cartridge can permit exposure of the photoreceptor. This can provided by a bar of 650 nm LEDs (light emitting diodes). An external computer controlled servo motor can drive the photoreceptor cartridge, often at 90 rpm. An inline rotary torque sensor measures the torque in Newton-meters versus time in seconds. An external power supply can apply a sinusoidal signal of 1.7 kVpp at 1 kHz to the BCR. The DC offset of the signal can be adjusted to give −500VDC at the photoreceptor surface (at zero exposure; in the dark), often the offset is between −500VDC and −600VDC. Another external power supply can apply a square wave signal of 500Vpp at 2 kHz to the developer roll. The DC offset can be set at 300VDC. The intensity of the LED bar can be adjusted to give a photoreceptor image-patch voltage of −150VDC. The power to the LED bar can be pulsed in such a way as to give one image patch approximately every 10 revolutions. The cartridge can be cycled 5000 times for a measurement. The output of the measurement can be a torque versus cycles graph. (See the Examples below and FIGS. 5 and 6.)

Some embodiments herein are drawn to image forming apparatuses comprising: an imaging member comprising a support and an imaging layer formed on the support, wherein the imaging member has an outer layer having an outer surface and fluoropolymer particles that are imbedded in and/or bonded to the outer surface of the outer layer; a charging unit that applies electrostatic charge on the imaging member; a developing unit that develops a toner image onto the imaging member; a transfer unit that transfers the toner image from the imaging member to a media; and a cleaning unit that cleans the imaging member.

Certain embodiments are drawn to processes for preparing an imaging member comprising: coating an imaging layer with an outer layer formulation, wherein the imaging layer can be disposed on a support; drying the outer layer formulation to form an outer layer disposed on the imaging layer having an outer surface; and applying fluoropolymer particles to the outer layer during the drying of the outer layer.

Certain embodiments herein are drawn to methods of making an imaging member comprising: pressing fluoropolymer particles into an outer layer formulation coated on a photosensitive substrate during curing of the outer layer formulation.

BRIEF DESCRIPTION OF THE DRAWINGS

FIG. 1 *a*) depicts an imaging member/photoreceptor drum with a protective low wear overcoat. FIG. 1 *b*) depicts an imaging member with a wax layer disposed on the overcoat layer. FIG. 1 *c*) depicts an imaging member/photoreceptor drum of certain embodiments.

DETAILED DESCRIPTION

Figure 1C:
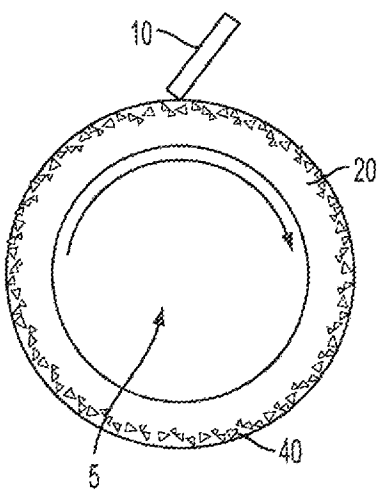
FIG. 1 depicts cross-sectional views of imaging members in a drum configuration.

The term "photoreceptor" or "photoconductor" is generally used interchangeably with the phrase "imaging member." The term "electrophotographic" includes "electrostatographic" and "xerographic." The phrase "charge transport molecule" is generally used interchangeably with, the phrase "hole transport molecule."

Some embodiments are drawn to processes for preparing an imaging member comprising: coating an imaging layer with an outer layer formulation, wherein the imaging layer can be disposed on a support; drying the outer layer formulation to form an outer layer disposed on the imaging layer having an outer surface; and applying fluoropolymer particles to the outer layer thereby imbedding the fluoropolymer particles in the outer surface. Certain embodiments can further comprise curing the outer layer having the imbedded fluoropolymer particles. The imaging layer can have a multilayered structure that comprises a charge generation layer disposed on the support, a charge transport layer disposed on the charge generation layer and the outer layer can be coated on the imaging layer so that it is disposed over the charge transport layer of the imaging layer.

Certain embodiments are drawn to methods of making an imaging member comprising: pressing fluoropolymer particles into an outer layer formulation coated on a photosensitive substrate, wherein the photosensitive substrate comprises at least an imaging layer disposed under the outer layer; and curing the outer layer formulation.

Some embodiments are drawn to imaging members comprising: a support, an imaging layer disposed on the support, an outer layer disposed on the imaging layer, wherein the outer layer has an outer surface and fluoropolymer particles that are imbedded in and/or bonded to the outer surface of the outer layer. As used herein, "bonding" of fluoropolymer particles refers to adhering, sticking, or attaching of the particles to the outer surface. "Imbedding" of the fluoropolymer particles relates to the particles being at least partially implanted within the surface layer.

Other embodiments are drawn to image forming apparatuses comprising: an imaging member comprising a support and an imaging layer formed on the support, wherein the imaging member has an outer layer having an outer surface and fluoropolymer particles that are imbedded in and/or bonded to the outer surface of the outer layer; a charging unit that applies electrostatic charge on the imaging member; a developing unit that develops a toner image onto the imaging member; a transfer unit that transfers the toner image from the imaging member to a media; and a cleaning unit that cleans the imaging member.

Imaging members can have a configuration known in the art. For example imaging members can be in a cylinder, a drum, a drelt (a cross between a drum and a belt), film, or belt configuration. The imaging members can have a multi-layered configuration. In certain embodiments, an imaging member can comprise a support and an electrically conductive ground plane, an undercoat layer, a charge generation layer and, a charge transport layer.

In certain embodiments, an imaging member can have a belt configuration. The belt configuration can be provided with an anti-curl back coating, a support/substrate, an electrically conductive ground plane, an undercoat layer, an adhesive layer, a charge generation layer, a charge transport layer, and/or an overcoat/outer layer, among others known in the art. In some embodiments, the imaging layer can be multilayered and can comprise the electrically conductive ground plane, the undercoat layer, the adhesive layer, and the charge generation layer. An exemplary photoreceptor having a belt configuration is disclosed in U.S. Pat. No. 5,069,993, the entire disclosure thereof being incorporated herein by reference.

The Overcoat—Outer Layer

Certain embodiments are drawn to photoreceptors/imaging members that include an outer layer with fluoropolymer particles imbedded in and/or bonded to the outer layer. In embodiments, the outer layer can be a polymeric overcoat or PASCO (polymeric anti-scratch overcoat) layer. The outer layer can be disposed over a layer comprising a charge transport component or the outer layer itself can comprise a charge transport component. In embodiments the outer layer can provide surface protection as well as improve resistance of an imaging member to abrasion.

In embodiments, the outer layer can have a thickness ranging from about 0.1 micron to about 10 microns or from about 1 micron to about 10 microns, or in a specific embodiment, about 3 microns. The outer layer can include thermoplastic organic polymers or inorganic polymers that are electrically insulating or slightly semi-conductive. For example, a outer layer can include a suitable resin selected from polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. The outer layer can be continuous and have a thickness of between about 0.5 micron and about 10 microns, between about 0.5 micron and about 2 microns, or between about 0.5 micron and about 6 microns.

In some embodiments, the outer layer can include a charge transport component and, optionally, organic polymers or inorganic polymers. In certain embodiments, a charge transport component can be a component of imaging member/photoreceptor without being a component of the outer layer overcoat. In some embodiments, the outer layer/overcoat comprises a charge transport component and, optionally, another layer of the imaging member/photoreceptor also comprises a charge transport component.

The polymeric overcoat or PASCO layer can be prepared using formulations known in the art for overcoating a photoreceptor. In some embodiments, a PASCO overcoating layer formulation can comprise a hydroxyl-containing charge transport molecule, a polyol polymer binder, and a melamine-based curing agent, which, upon thermal curing, can form a crosslinked overcoat/outer layer.

The outer layer can provide surface protection as well as improved resistance to abrasion. In embodiments, the outer layer/overcoat can have a thickness ranging from about 0.1 micrometer to about 25 micrometers or from about 1 micrometer to about 15 micrometers, or in a specific embodiment, about 3 to about 10 micrometers.

In some embodiments the outer layer can be prepared with a curable composition comprising a charge transport component and a curing agent and the outer layer comprises the cross-linked product. The transport component can comprise a tertiary amine having at least one curable functional group selected from the group consisting of a hydroxyl, a hydroxylmethyl, an alkoxymethyl, a hydroxyalkyl having from 1 to 15 carbons, an acrylate and mixtures of two or more thereof. The alkoxymethyl can be —$CH_2OR$, wherein R can be an alkyl having from about 1 to about 10 carbons or from about 1 to about 5 carbons, and the hydroxylalkyl can have about 1 to about 10 carbons, or from about 1 to about 5 carbons. The curing agent can be selected from the group consisting of melamine-formaldehyde resin, a phenol resin, an isocyalate or a masking isocyalate compound, an acrylate resin, a polyol resin, and mixtures of two or more thereof.

In embodiments, the outer layer can include a charge transport component. In particular embodiments, the outer layer comprises a charge transport component comprised of a tertiary arylamine containing a substituent capable of self cross-linking or reacting with the polymer resin to form cured composition. Specific examples of charge transport component suitable for outer layer comprise the tertiary arylamine with a general formula of

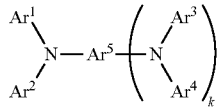

wherein $Ar^1$, $A^2$, $Ar^3$, and $Ar^4$ each independently represents an aryl group having from about 4 to about 10 carbon atoms, or from about 5 to about 10 carbons, or from about 6 to about 10 carbons and $Ar^5$ represents aromatic hydrocarbon group having about 4 to about 10 carbon atoms, or from about 5 to about 10 carbons, or from about 6 to about 10 carbons and k represents 0 or 1, and wherein at least one of $Ar^1$, $Ar^2$, $Ar^3$, $Ar^4$, and $Ar^5$ comprises a substituent selected from the group consisting of hydroxyl (—OH), a hydroxymethyl (—$CH_2OH$), an alkoxymethyl (—$CH_2OR$, wherein R can be an alkyl having from about 1 to about 10 carbons or from about 1 to about 5 carbons), a hydroxylalkyl having about 1 to about 10 carbons, or from about 1 to about 5 carbons and mixtures thereof. In other embodiments, $Ar^1$, $Ar^2$, $Ar^3$, and $Ar^4$ each independently represent a phenyl or a substituted phenyl group, and $Ar^5$ represents a biphenyl or a terphenyl group.

Additional examples of charge transport component which comprise a tertiary arylamine include the following:

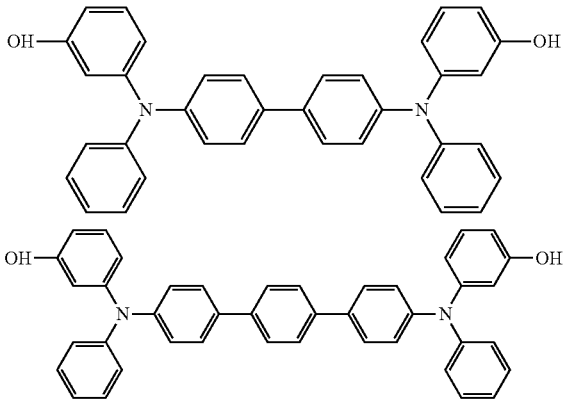

-continued

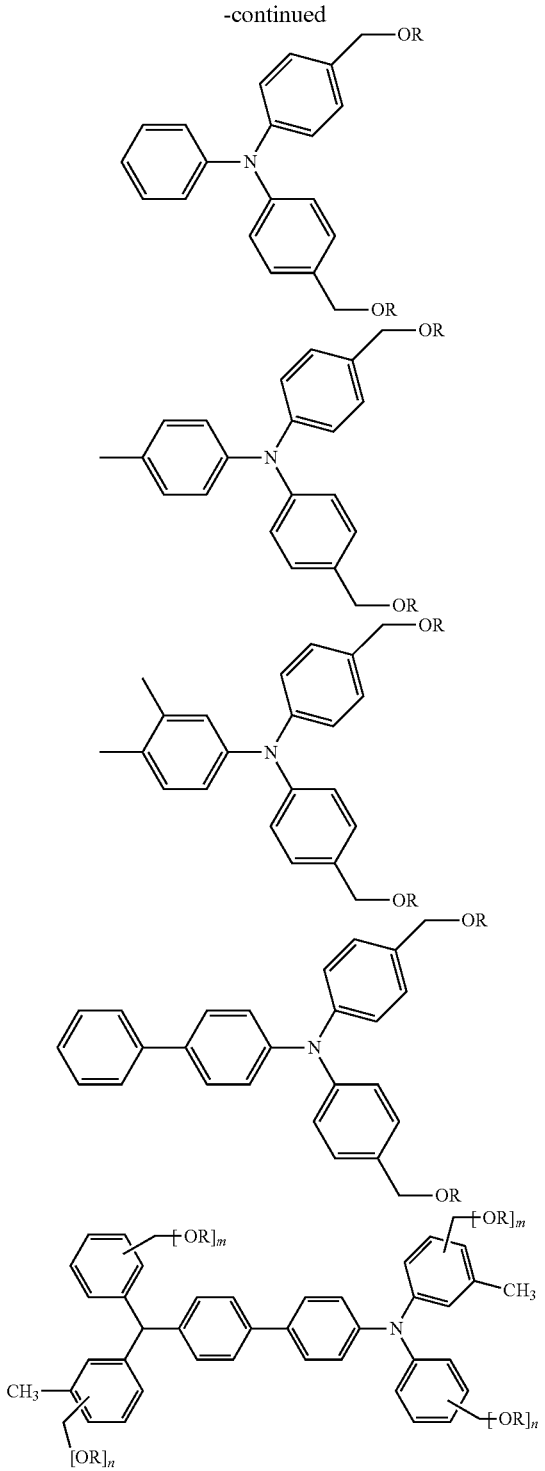

and the like, wherein R can be a substituent selected from the group consisting of hydrogen atom, and an alkyl having from 1 to 6 carbons, and m and n each independently represents 0 or 1, wherein m+n>1. In specific embodiments, the outer layer can include an additional curing agent to form a cured overcoat composition. Illustrative examples of the curing agent can be selected from the group consisting of a melamine-formaldehyde resin, a phenol resin, an isocyalate or a masking isocyalate compound, an acrylate resin, a polyol resin, or the mixture thereof.

In specific embodiments, the charge or hole transport molecule can be selected from the group consisting of N,N'-diphenyl-N,N'-bis(hydroxyphenyl)-[1,1'-terphenyl]-4,4'-diamine, and N,N'-diphenyl-N,N'-bis(3-hydroxyphenyl)-[1,1'-biphenyl]-4,4'-diamine, and mixtures thereof. In certain embodiments, the charge transport component comprises a tertiary arylamine selected from the group consisting of N,N'-diphenyl-N,N'-bis(3-methylphenyl)-(1,1'-biphenyl)-4,4'-diamine, N,N'-diphenyl-N,N'-bis(4-methylphenyl)-(1,1'-biphenyl)-4,4'-diamine, N,N,N',N'-tetrakis(4-methylphenyl)-1,1'-biphenyl)-4,4'-diamine, N,N'-bis(4-butylphenyl)-N,N'-di-p-tolyl-[p-terphenyl]-4,4'-diamine, and N,N'-bis(4-butylphenyl)-N,N'-di-m-tolyl-[p-terphenyl]-4,4'-diamine, and mixtures thereof.

In some embodiments, the outer layer can also include a crosslinking agent, an optional resin and/or one or more optional surface additives. In such embodiments, the crosslinking agent can be selected from the group consisting of methylated formaldehyde-melamine resin, methoxymethylated melamine resin, ethoxymethylated melamine resin, propoxymethylated melamine resin, butoxymethylated melamine resin, hexamethylol melamine resin, alkoxyalkylated melamine resins, and mixtures thereof. In such embodiments, the resin can be selected from the group consisting of an acrylic polyol, polyesterpolyols, polyacrylatepolyols, and mixtures thereof. In such embodiments, the one or more surface additives can be selected from the group consisting of silicone modified polyacrylate, alkylsilanes, perfluorinated alkylalcohols, and mixtures thereof.

Any suitable and conventional technique can be utilized to form and thereafter apply the outer layer formulation to the imaging layer/photosensitive substrate. The outer layer/overcoat can be formed in a single coating step or in multiple coating steps. Dip coating, ring coating, spray, gravure or any other drum coating methods can be used.

Drying of the deposited formulation can be effected by any suitable conventional technique such as oven drying, infra red radiation drying, air drying and the like. The thickness of the outer layer/overcoat after drying can be from about 10 μm to about 40 μm or from about 12 μm to about 36 μm. In another embodiment the thickness can be from about 14 μm to about 36 μm.

The Fluoropolymer Particles and Their Application to the Outer Layer/Overcoat As used herein and unless otherwise specified, the term "fluoropolymer" refers to any polymer that contains fluorine atom. In embodiments, the fluorine content can be at least about 80%, or at least about 50%, or at least about 30% by weight of the total fluoropolymer.

The fluoropolymer particle can be in the form of a grain, a sphere, a crystal, a platelet, a wire, a needle, a fiber, a thread, a flake, or the like. The fluoropolymer particles can have random particle sizes or non-uniform particle distributions. Further, the fluoropolymer particles can have irregular shapes. In embodiments, the fluoropolymer particle can have at least one dimension of at least about 1 nm, or at least about 10 nm, or ranging from about 10 nm to about 10 μm. In embodiments, the fluoropolymer particles can have an elongated structure having a diameter of at least about 1 nm, or at least about 10 nm, or ranging from about 10 nm to about 1 μm. In embodiments, the elongated fluoropolymer particle can have an aspect ratio of at least about 1, or at least about 10, or ranging from about 100 to about 10000. In some embodiments, fluoropolymer particles can be prepared by scraping particles from a block of a fluoropolymer. In certain embodiments, scraping the fluoropolymer block can yield particles having irregular shapes and random sizes. The PTFE particles were observed to have a wide distribution Example of fluoropolymers can include polytetrafluoroethylene (PTFE, e.g., by DuPont under the trade name TEFLON), perfluoroalkoxy polymer resin (PFA, e.g., by DuPont under the trade name TEFLON), fluorinated ethylene-propylene, (FEP, e.g., by DuPont under the trade name TEFLON), polyethylenetetrafluoroethylene (PETFE, e.g., by DuPont under the registered tradename Tefzel, or by Asahi Glass company under the registered trade name FLUON), polyvinylfluoride (PVF, e.g., by DuPont under the registered trade name TEDLAR), polyethylenechlorotrifluoroethylene (PECTFE, e.g., by Solvay Solexis under the registered trade name HALAR), polyvinylidene fluoride (PVDF, e.g., by Arkema under the registered trade name of KYNAR), copolymers of tetrafluoroethylene (TFE) and perfluoro(ethyl vinyl ether) (PEVE), copolymers of tetrafluoroethylene (TFE) and perfluoro(methyl vinyl ether) (PMVE), copolymers of hexafluoropropylene (HFP) and vinylidene fluoride (VDF or VF2), terpolymers of tetrafluoroethylene (TFE), vinylidene fluoride (VDF) and hexafluoropropylene (HFP), and tetrapolymers of TFE, VF2, and HFP (such as, VITON® GF by DuPont, among others). The fluoropolymer particles can comprise polytetrafluoroethylene (PTFE) in some embodiments. In certain embodiments the fluoropolymer particles consist essentially of PTFE. In some embodiments the fluoropolymer particles can comprise VITON® (e.g., tetrapolymer of TFE, VF2, HFP and a small amount of cure site monomer).

In some embodiments, the fluoropolymer particles can comprise a polymer having at least a monomer repeat unit selected from the group consisting of tetrafluoroethylene, vinylidene fluoride, hexafluoropropylene, perfluoro(methyl vinyl ether), perfluoro(ethyl vinyl ether), and perfluoro(propyl vinyl ether), and mixtures thereof. In some embodiments, the fluoropolymer particles can comprise a polymer having tetrafluoroethylene as a monomer repeat unit. The fluoropolymer particles comprise polytetrafluoroethylene (PTFE) in certain embodiments herein.

The fluoropolymer particles can be present in an amount of up to about 30% by weight of total weight of the outer layer of an imaging member herein, in an amount of about up to about 10% by weight of total weight of the outer layer, or in an amount up to about 5% by weight of total weight of the outer layer. In embodiments, the fluoropolymer can be bonded to or imbedded in the outer layer in an amount of between about 0.5% and about 30%, between about 0.5% and about 10%, or between about 0.5% and about 5% of the outer layer. In certain embodiments, the fluoropolymer particles can have a surface density of at least about $10^{-6}$ g/cm$^2$ on the surface of the outer layer/overcoat. In some embodiments, such surface density can range from about $10^{-6}$ g/cm$^2$ to about $10^3$ g/cm$^2$, or from about $10^{-6}$ g/cm$^2$ to about $10^{-3}$ g/cm$^2$.

Embodiments herein can provide a simple and effective way to improve interaction between the cleaning blade and the photoreceptor. The outer layer formulation can be coated onto a charge transport layer. A rigid rod can be pressed and rolled with high pressure against the photoreceptor during a specific time period after coating, and optionally before curing of the outer layer to cause fluoropolymer particles to be pressed into an outer layer formulation.

The outer layer can be subjected to ambient drying conditions prior to application of the fluoropolymer particles. In embodiments, the ambient drying can take place from about 1 to about 20 minutes, or from about 5 to about 10 minutes. Ambient drying conditions can be from about 15° C. to about 35° C. and about 10% to about 50% humidity. In embodiments, ambient drying conditions can be from about 20° C. to about 25° C. and about 10% to about 50% relative humidity. In embodiments, a rod can be rolled against a photoreceptor at a force of from about 10 to about 1000 Newtons, or from about 100 to about 200 Newtons. The step of pressing and rolling can take place from about 1 minute to about 20 minutes, or from about 5 minutes to about 10 minutes after coating with an outer layer formulation (i.e., immediately after the ambient drying step). The step of pressing and rolling can take place during partial curing of the outer layer, in some embodiments. The rod can be used to apply fluoropolymer particles to the outer surface of the outer layer to produce an outer layer with particles imbedded therein and/or bonded thereto.

In order to produce an outer layer, in some embodiments, there can be forced air and high temperatures provided during or after application of the fluoropolymer particles. The rotations per minute of an imaging layer/photoreceptor having an overcoat applied can be within a specific range. In embodiments, the forced air can create a photoreceptor surface temperature that can be elevated (as measured with an infrared (IR) probe) of from about 50° C. to about 200° C., or from about 100° C. to about 170° C. The rotations of the photoreceptor that an overcoat is being applied to can be at least about 30 rpm, or from about 60 rpm to about 120 rpm.

In some embodiments, after fluoropolymer particles are pressed to an outer layer/overcoat formulation, the formulation can be cured. In certain embodiments, the outer layer formulation can be cured in an oven at a temperature of from about 120° C. to about 170° C. for about 5 minutes to about 60 minutes, or from about 135° C. to about 160° C. for about 30 to 50 minutes.

In embodiments, there can be provided a system for making the imaging member. The system can comprise a rod mounted on a spring loaded and pressure screw mount. The rod can be a freely rotating rigid rod. In embodiments, the rod can be made from metallic materials such as steel, nickel, titanium nitride, and chrome. Other materials such as glass, plastics, ceramics, and composites can also be included so long as the materials are able to form a rigid rod with a yield strength greater than the imaging member surface.

As used herein, the term "rigid" is used to indicate a material that is not flexible. In embodiments, the rod can have a diameter of from about 5 millimeters to about 15 millimeters. In one embodiment, the rod can have a diameter of about equal diameter to the imaging member drum. A photoreceptor drum can be mounted onto an anchored support and the rod can then be pressure set against the drum via a pressure sub-system. The pressure sub-system comprises a hand crank which can be connected to the freely rotating photoreceptor drum. The two cylinders (e.g., drum and rod) can be rotated together under pressure. Uniform contact between the drum and the rod can be an issue as both are very rigid. To overcome this issue, a TEFLON or polymeric counter roller can be used to apply uniform pressure onto the rod toward the photoreceptor drum.

Imaging Member Configuration

Figure 1B:
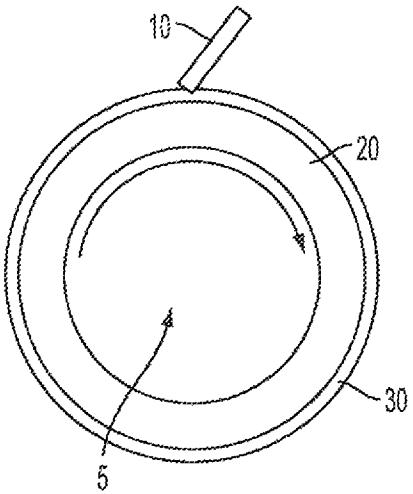
Figure 1A:
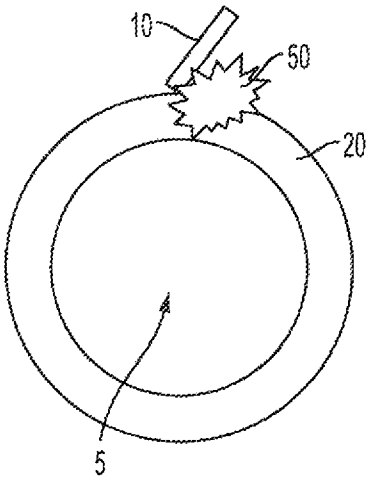

Certain aspects can be better understood by reference to the drawings. FIG. 1 depicts cross-sectional views of imaging members in a drum configuration. FIG. 1 *a*) depicts an imaging member/photoreceptor drum 5 with a protective low wear overcoat 20 known in the art. A blade 10 can be used to clean the surface of the low wear overcoat 20. The imaging member of FIG. 1 *a*) results in severe initial torque 50.

FIG. 1 *b*) depicts an imaging drum 5 with a wax layer 30 disposed on the overcoat/outer layer 20, which represents an improvement over the imaging member of FIG. 1 *a*) in that it overcomes the severe initial torque between the blade 10 and the overcoat 20. FIG. 1 *c*) depicts an imaging member/photoreceptor of one embodiment. The photoreceptor drum 5 has an overcoat 20 with fluoropolymer (e.g., PTFE, among others) particles 40 imbedded in and/or bonded to the overcoat 20. The imaging member of FIG. 1 *c*) can avoid issues related to severe initial torque and the blade 10 can conform to the overcoat 40 surface after the initial cycles that wear off the fluoropolymer particle layer.

Imaging members (one embodiment depicted in FIG. 1 *c*)) can act to dramatically reduce initial torque and overcome issues associated with initial torque. Imaging members can produce little or no contamination issues and do not introduce new print quality issues. Some imaging members can comprise an outer layer with particles of 100% PTFE that are imbedded into the outermost portion/surface of the outer layer and/or bonded to the outer layer. The PTFE can be applied to a photoreceptor surface via mechanical application and heat during final curing of the overcoat/outer layer to produce a thin outermost layer of imbedded, and/or bonded PTFE.

A thin surface of imbedded fluoropolymer (e.g., PTFE) particles (only in the outermost surface) can act as a sacrificial low surface energy layer that enables a photoreceptor drum to freely turn in a electrophotographic apparatus at time zero and cam also have enough roughness to enable a blade to conform to the drum surface, which in turn enables the drum to freely rotate even after the fluoropolymer layer wears completely off after only a few thousand cycles (FIG. 1 *c*)). If a wax or oil lubricant is applied to the photoreceptor surface to overcome torque there is no blade conformation and, once the lubricant wears away severe torque will return (FIG. 1 *b*)). The conformation of the blade to the overcoat can be the key to realizing the long life potential of low wear overcoats.

In specific embodiments, there can be provided an imaging member such that, positioned in between a support and the outer layer, there can be positioned a charge generation layer (e.g., as a layer of a multilayered imaging layer) comprising a photosensitive pigment selected from the group consisting of metal free phthalocyanine, titanyl phthalocyanine, chlorogallium phthalocyanine, hydroxygallium phthalocyanine, and a mixture of alkylhydroxy gallium phthalocyanine and hydroxygallium phthalocyanine, and a perylene, and the mixture thereof.

The photoreceptor support can be opaque or substantially transparent, and can comprise any suitable organic or inorganic material having the requisite mechanical properties. The entire support can comprise the same material as that in the electrically conductive surface, or the electrically conductive surface can be merely a coating on the support/substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It can be a single metallic compound or dual layers of different metals and/or oxides.

The support can also be formulated entirely of an electrically conductive material, or it can be an insulating material including inorganic or organic polymeric materials, such as MYLAR®, a commercially available biaxially oriented polyethylene terephthalate from DuPont, or polyethylene naphthalate available as KALADEX® 2000, with a ground plane layer comprising a conductive titanium or titanium/zirconium coating, otherwise a layer of an organic or inorganic material having a semiconductive surface layer, such as indium tin oxide, aluminum, titanium, and the like; or exclusively be made up of a conductive material such as, aluminum, chromium, nickel, brass, other metals and the like. The thickness of the support depends on numerous factors, including mechanical performance and economic considerations.

The support/photoreceptor can have a number of different configurations, such as for example, a plate, a cylinder, a drum, a scroll, an endless flexible belt, and the like. In the case of the support/photoreceptor being in the form of a belt, the belt can be seamed or seamless. In embodiments, the photoreceptor/imaging member herein can be in a drum configuration.

The thickness of the support/photosensitive substrate depends on numerous factors, including flexibility, mechanical performance, and economic considerations. The thickness of the support of the present embodiments can be at least about 500 micrometers, or no more than about 3000 micrometers, or be at least about 750 micrometers, or no more than about 2500 micrometers.

The electrically conductive ground plane can be an electrically conductive metal layer which can be formed, for example, on the support by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer can vary in thickness over substantially wide ranges depending on the optical transparency and flexibility desired for the electrophotoconductive member. Accordingly, for a flexible photoresponsive imaging device, the thickness of the conductive layer can be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it can be that these overlying contiguous layers can, in fact, contact a thin metal oxide layer that has formed on the outer surface of the oxidizable metal layer. Generally, for rear erase exposure, a conductive layer light transparency of at least about 15 percent can be desirable. The conductive layer need not be limited to metals. Other examples of conductive layers can be combinations of materials such as conductive indium tin oxide as transparent layer for light having a wavelength between about 4000 Angstroms and about 9000 Angstroms or a conductive carbon black dispersed in a polymeric binder as an opaque conductive layer.

After deposition of the electrically conductive ground plane layer, a hole blocking layer can be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer can be utilized. The hole blocking layer can include polymers such as polyvinylbutryral, epoxy resins, polyesters, polysiloxanes, polyamides, polyurethanes and the like, or can be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino) titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_4]CH_3Si(OCH_3)_2$, (gamma-aminopropyl) methyl diethoxysilane, as disclosed in U.S. Pat. Nos. 4,338,387, 4,286,033 and 4,291,110, the contents of which are incorporated herein by reference in their entirety.

General embodiments of the undercoat layer can comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials can include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer can be continuous and have a thickness of less than about 0.5 micrometer because greater thicknesses can lead to undesirably high residual voltage. A hole blocking layer of between about 0.005 micrometer and about 0.3 micrometer can be used, because charge neutralization after the exposure step can be facilitated and optimum electrical performance can be achieved. A thickness of between about 0.03 micrometer and about 0.06 micrometer can be used for hole blocking layers for optimum electrical behavior. The blocking layer can be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer can be applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 can be satisfactory for spray coating.

A charge generation layer can thereafter be applied to the undercoat layer. Any suitable charge generation binder including a charge generating photoconductive material, which can be in the form of particles and dispersed in a film forming binder, such as an inactive resin, can be utilized. Examples of charge generating materials include, for example, inorganic photoconductive materials such as amorphous selenium, trigonal selenium, and selenium alloys selected from the group consisting of selenium-tellurium, selenium-tellurium-arsenic; selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof can be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions can be used where a photoconductive layer enhances or reduces the properties of the charge generation layer. Other suitable charge generating materials known in the art can also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245, the entire disclosure thereof being incorporated herein by reference.

Any suitable inactive resin materials can be employed as a binder in the charge generation layer, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder can be PCZ-400 (poly(4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume or no more than about 90 percent by volume of the charge generating material can be dispersed in at least about 95 percent by volume, or no more than about 10 percent by volume of the resinous binder, and more specifically at least about 20 percent, or no more than about 60 percent by volume of the charge generating material can be dispersed in at least about 80 percent by volume, or no more than about 40 percent by volume of the resinous binder composition.

In specific embodiments, the charge generation layer can have a thickness of at least about 0.1 μm, or no more than about 2 μm, or of at least about 0.2 μm, or no more than about 1 μm. These embodiments can be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness can generally be related to binder content. Higher binder content compositions generally employ thicker layers for charge generation.

In a drum photoreceptor, the charge transport layer can comprise a single layer of the same composition. As such, the charge transport layer will be discussed specifically in terms of a single layer, but the details will be also applicable to an embodiment having dual charge transport layers. The charge transport layer can thereafter be applied over the charge generation layer and can include any suitable transparent organic polymer or non-polymeric material capable of supporting the injection of photogenerated holes or electrons from the charge generation layer and capable of allowing the transport of these holes/electrons through the charge transport layer to selectively discharge the surface charge on the imaging member surface. In one embodiment, the charge transport layer not only serves to transport holes, but also protects the charge generation layer from abrasion or chemical attack and can therefore extend the service life of the imaging member. The charge transport layer can be a substantially non-photoconductive material, but one which supports the injection of photogenerated holes from the charge generation layer.

The layer can be transparent in a wavelength region in which the electrophotographic imaging member can be used when exposure can be affected there to ensure that most of the incident radiation can be utilized by the underlying charge generation layer. The charge transport layer should exhibit excellent optical transparency with negligible light absorption and no charge generation when exposed to a wavelength of light useful in xerography, e.g., 400 to 900 nanometers. In the case when the photoreceptor can be prepared with the use of a transparent support and also a transparent or partially transparent conductive layer, image wise exposure or erase can be accomplished through the support with all light passing through the back side of the support. In this case, the materials of the layer need not transmit light in the wavelength region of use if the charge generation layer can be sandwiched between the support and the charge transport layer. The charge transport layer in conjunction with the charge generation layer can be an insulator to the extent that an electrostatic charge placed on the charge transport layer is not conducted in the absence of illumination. The charge transport layer should trap minimal charges as the charge passes through it during the discharging process.

The charge transport layer can include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule can be dissolved in the polymer to form a homogeneous phase; and molecularly dispersed in embodiments refers, for example, to charge transporting molecules dispersed in the polymer, the small molecules being dispersed in the polymer on a molecular scale. The charge transport component can be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer and capable of allowing the transport of these holes through the charge transport layer in order to discharge the surface charge on the charge transport layer. The high mobility charge transport component can comprise small molecules of an organic compound which cooperate to transport charge between molecules and ultimately to the surface of the charge transport layer. For example, but not limited to, N,N'-diphenyl-N,N-bis(3-methyl phenyl)-1, 1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally can be of a thickness of from about 5 to about 75 micrometers, and more specifically, of a thickness of from about 15 to about 40 micrometers. Examples of charge transport components are aryl amines of the following formulas/structures:

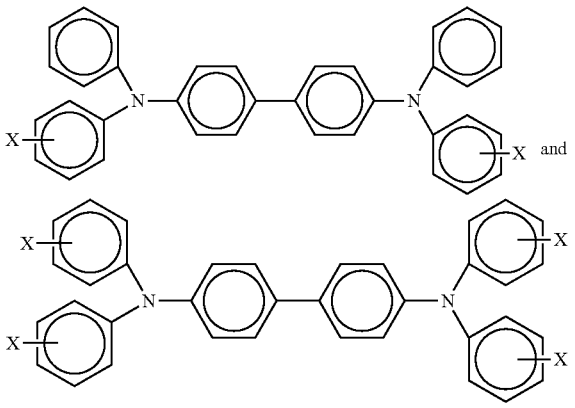

wherein X can be a suitable hydrocarbon like alkyl, alkoxy, aryl, and derivatives thereof; a halogen, or mixtures thereof, and especially those substituents selected from the group consisting of Cl and $CH_3$; and molecules of the following formulas

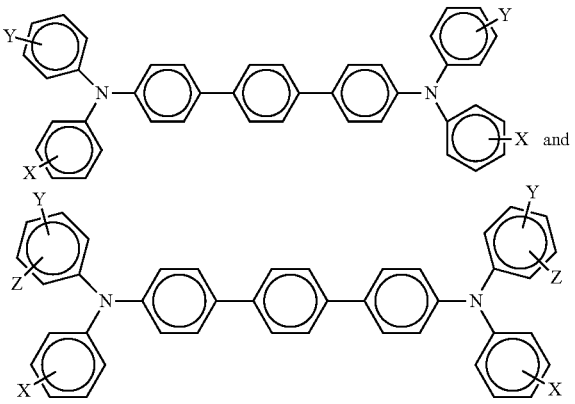

wherein X, Y and Z are independently alkyl, alkoxy, aryl. a halogen, or mixtures thereof, and wherein at least one of Y and Z are present.

Alkyl and alkoxy contain, for example, from 1 to 25 carbon atoms, and more specifically, from 1 to 12 carbon atoms, such as methyl, ethyl, propyl, butyl, pentyl, and the corresponding alkoxides. Aryl can contain from 6 to 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl can be selected from the group consisting of methyl, ethyl, propyl, butyl, hexyl, and the like; N,N'-diphenyl-N,N'-bis(halophenyl)-1,1'-biphenyl-4,4'-diamine wherein the halo substituent can be a chloro substituent; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like. Other known charge transport layer molecules can be selected in embodiments, reference for example, U.S. Pat. Nos. 4,921,773 and 4,464,450, the disclosures of which are incorporated herein by reference in their entirety.

Examples of the binder materials selected for the charge transport layers include components, such as those described in U.S. Pat. No. 3,121,006, the disclosure of which is incorporated herein by reference in its entirety. Specific examples of polymer binder materials include polycarbonates, polyarylates, acrylate polymers, vinyl polymers, cellulose polymers, polyesters, polysiloxanes, polyamides, polyurethanes, poly (cyclo olefins), and epoxies, and random or alternating copolymers thereof. In embodiments, the charge transport layer, such as a hole transport layer, can have a thickness of at least about 10 μm, or no more than about 40 μm.

Examples of components or materials optionally incorporated into, the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R. NR, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd.); phosphite antioxidants such as MARKT™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layer can be from about 0 to about 20, from about 1 to about 10, or from about 3 to about 8 weight percent.

The charge transport layer can be an insulator to the extent that the electrostatic charge placed on the hole transport layer is not conducted in the absence of illumination at a rate sufficient to prevent formation and retention of an electrostatic latent image thereon. The charge transport layer can be substantially nonabsorbing to visible light or radiation in the region of intended use, but can be electrically "active" in that it allows the injection of photogenerated holes from the photoconductive layer, that can be the charge generation layer, and allows these holes to be transported through itself to selectively discharge a surface charge on the surface of the active layer.

In addition, in the present embodiments using a belt configuration, the charge transport layer can consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer can have an individual thickness of from about 2 μm to about 20 μm. Moreover, the charge transport layer can be configured such that it can be used as a top layer of the photoreceptor to inhibit crystallization at the interface of the charge transport layer and the outer layer. In another embodiment, the charge transport layer can be configured such that it can be used as a first pass charge transport layer to inhibit microcrystallization occurring at the interface between the first pass and second pass layers.

An optional adhesive interface layer can be provided in certain configurations, such as for example, in flexible web configurations. An interface layer can be situated between a blocking layer and a charge generation layer, in certain web configurations. The interface layer can include a copolyester resin. Exemplary polyester resins which can be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer can be applied directly to a hole blocking layer. Thus, the adhesive interface layer in embodiments can be in direct contiguous contact with both a underlying hole blocking layer and an overlying charge generator layer to enhance adhesion bonding to provide linkage. In yet other embodiments, the adhesive interface layer can be entirely omitted.

Any suitable solvent or solvent mixtures can be employed to form a coating solution of a polyester for the adhesive interface layer. Solvents can include tetrahydrofuran, toluene, monochlorobenzene, methylene chloride, cyclohexanone, and the like, and mixtures thereof. Any other suitable and conventional technique can be used to mix and thereafter apply the adhesive layer coating mixture to the hole blocking layer. Application techniques can include spraying, dip coating, roll coating, wire wound rod coating, and the like. Drying of the deposited wet coating can be effected by any suitable conventional process, such as oven drying, infra red radiation drying, air drying, and the like.

The adhesive interface layer can have a thickness of at, least about 0.01 micrometers, or no more, than about 900 micrometers after drying. In embodiments, the dried thickness can be from about 0.03 micrometers to about 1 micrometer.

The ground strip can comprise a film forming polymer binder and electrically conductive particles. Any suitable electrically conductive particles can be used in the electrically conductive ground strip layer. The ground strip can comprise materials which include those enumerated in U.S. Pat. No. 4,664,995, the entire disclosure thereof being incorporated herein by reference. Electrically conductive particles include carbon black, graphite, copper, silver, gold, nickel, tantalum, chromium, zirconium, vanadium, niobium, indium, tin oxide and the like. The electrically conductive particles can have any suitable shape. Shapes can include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized. The ground strip layer can have a thickness of at least about 7 micrometers, or no more than about 42 micrometers, or of at least about 14 micrometers, or no more than about 27 micrometers.

An anti-curl back coating can comprise organic polymers or inorganic polymers that are electrically insulating or slightly semi-conductive. The anti-curl back coating provides flatness and/or abrasion resistance.

Anti-curl back coating can be formed at the back side of the support, opposite to the imaging layer. The anti-curl back coating can comprise a film forming resin binder and an adhesion promoter additive. The resin binder can be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), VITEL PE-100, VITEL PE-200, VITEL PE-307 (Goodyear), and the like. Usually from about 1 to about 15 weight percent adhesion promoter can be selected for film forming resin addition. The thickness of the anti-curl back coating can be at least about 3 Micrometers, or no more than about 35 micrometers, or about 14 micrometers.

Image Forming Apparatus

Some embodiments are drawn to image forming apparatuses comprising an imaging member/photoreceptor as described above, a charging unit that applies electrostatic charge on the imaging member, a developing unit that develops toner image onto the imaging member, a transfer unit that transfers the toner image from the imaging member to a media, and a cleaning unit that cleans the imaging member. In embodiments, the cleaning unit of the image forming apparatus can comprisea blade-type cleaner comprised of an elastic polymer. In these embodiments, the fluoropolymer particles imbedded in and/or bonded to an outer layer of an imaging member can offer greatly improved interaction between the cleaning blade and the outer layer which can improves print quality, reduce blade damage and cleaning failures and can extend overall CRU (customer replaceable unit) life.

Methods of Making Imaging Member

As discussed above, some embodiments are drawn to processes for preparing an imaging member comprising: coating an imaging layer with an outer layer formulation, wherein the imaging layer can be disposed on a support; drying the outer layer formulation to form an outer layer disposed on the imaging layer having an outer surface; and applying fluoropolymer particles to the outer layer during drying thereby imbedding the fluoropolymer particles in the outer surface. In certain embodiments, application of the fluoropolymer particles can comprise imbedding the fluoropolymer particles in the outer surface and/or bonding the fluoropolymer particles to the outer layer. Application of the fluoropolymer particles can be performed with a rigid rod and a block fluoropolymer source, in some embodiments. In other embodiments, application of the fluoropolymer particles to the outer layer can be performed with a rigid rod and a fluoropolymer particle source.

Certain embodiments are drawn to methods of making an imaging member comprising: pressing fluoropolymer particles into an outer layer formulation coated on a photosensitive substrate, wherein the photosensitive substrate comprises at least an imaging layer disposed under the outer layer; and curing the outer layer formulation. In embodiments, an outer layer formulation can be coated on a photosensitive substrate and allowed to dry (e.g., air dried at ambient conditions) for a time until the outer layer is not completely dried. Fluoropolymer particles can be applied with pressure and heat, such that the particles imbed in the outer layer surface, as the outer layer is permitted to harden/cure from its soft gel-like consistency. The outer layer surface temperature can be from about 50° C. to about 200° C., from about 80° C. to about 160° C. or from about 100° C. to about 120° C. Alternatively, the fluoropolymer particles can be sprayed or dropped without additional heat on the surface of the outer layer while it is soft/tacky, such that the particles stick/adhere/bond to the surface, and the device is subsequently permitted to cure completely (such that the outer layer is hardened), in some embodiments.

The present embodiments provide an imaging member comprising a support, an imaging layer disposed on the support, and an outer layer disposed on the imaging layer, wherein the outer layer comprises fluoropolymer particles imbedded in the outer surface of the outer layer and/or bonded thereto, as described above. An imaging member made using method herein can exhibit a reduction in torque. For example, an imaging member comprising an outer layer with fluoropolymer particles imbedded in the outer surface thereof or bonded thereto can exhibit a from about 10% to about 90%, about 10% to about 50%, or from about 30% to about 50% reduction in torque as compared to a control imaging member comprising an outer layer without the fluoropolymer particles.

The following Examples further define and describe embodiments herein. Unless otherwise indicated, all parts and percentages are by weight.

EXAMPLES

Comparative Example 1

Low Wear Overcoat

A photoreceptor was prepared having a low wear overcoat. A standard photoreceptor drum was cup coated with a polymeric anti-scratch overcoat (PASCO) overcoat layer. The PASCO overcoat was cured using a forced air oven at 155° C. for 40 minutes.

A coating solution for an undercoat layer comprising 100 parts by weight of a zirconium compound (trade name: ORGATIX ZC540, manufactured by Matsumoto Seiyaku Co., Ltd.), 10 parts by weight of a silane compound (trade name: A110, manufactured by Nippon Unicar Co., Ltd), 400 parts by weight of isopropanol solution and 200 parts by weight of butanol was prepared. The coating solution was applied onto a cylindrical aluminum (Al) substrate subjected to honing treatment by dip coating, and dried by heating at 150° C. for 10 minutes to form an undercoat layer having a film thickness of 0.1 micrometer.

A 0.5 micron thick charge generating layer was subsequently dip coated on top of the undercoat layer from a dispersion of Type V hydroxygallium phthalocyanine (12 parts by weight), alkylhydroxy gallium phthalocyanine (3 parts by weight), and a vinyl chloride/vinyl acetate copolymer. VMCH ($M_n$=27,000, about 86 weight percent of vinyl chloride, about 13 weight percent of vinyl acetate and about 1 weight percent of maleic acid) available from Dow Chemical (10 parts by weight), in 475 parts by weight of n-butylacetate.

Subsequently, a 25 μm thick charge transport layer (CTL) was dip coated on top of the charge generating layer from a solution of N,N'-diphenyl-N,N'-bis(3-methylphenyl)-1,1'-biphenyl-4,4'-diamine (82.3 parts by weight), 2.1 parts by weight of 2,6-di-tert-butyl-4-methylphenol (BHT) from Aldrich and a polycarbonate, PCZ-400 [poly(4,4'-dihydroxydiphenyl-1-1-cyclohexane), $M_w$=40,000] available from Mitsubishi Gas Chemical Company, Ltd. (123.5 parts by weight) in a mixture of 546 parts by weight of tetrahydrofuran (THF) and 234 parts by weight of monochlorobenzene. The CTL was dried at 115° C. for 60 minutes.

An overcoat layer comprising 65% N,N'-diphenyl-N,N'-bis(3-hydroxyphenyl)-[1,1'-biphenyl]-4,4'-diamine. 33% hexamethoxymethylmelamine, 1% Nacrue XP357 available from King Industries, Silclean 3700 available from BYK additives, at 30% solids in 1-methoxy-2-propanol was coated onto a photoreceptor drum and then cured in an oven at 155° C. for about 40 minutes.

Comparative Example 2

Low Wear Overcoat and Wax Layer

Figure 2:
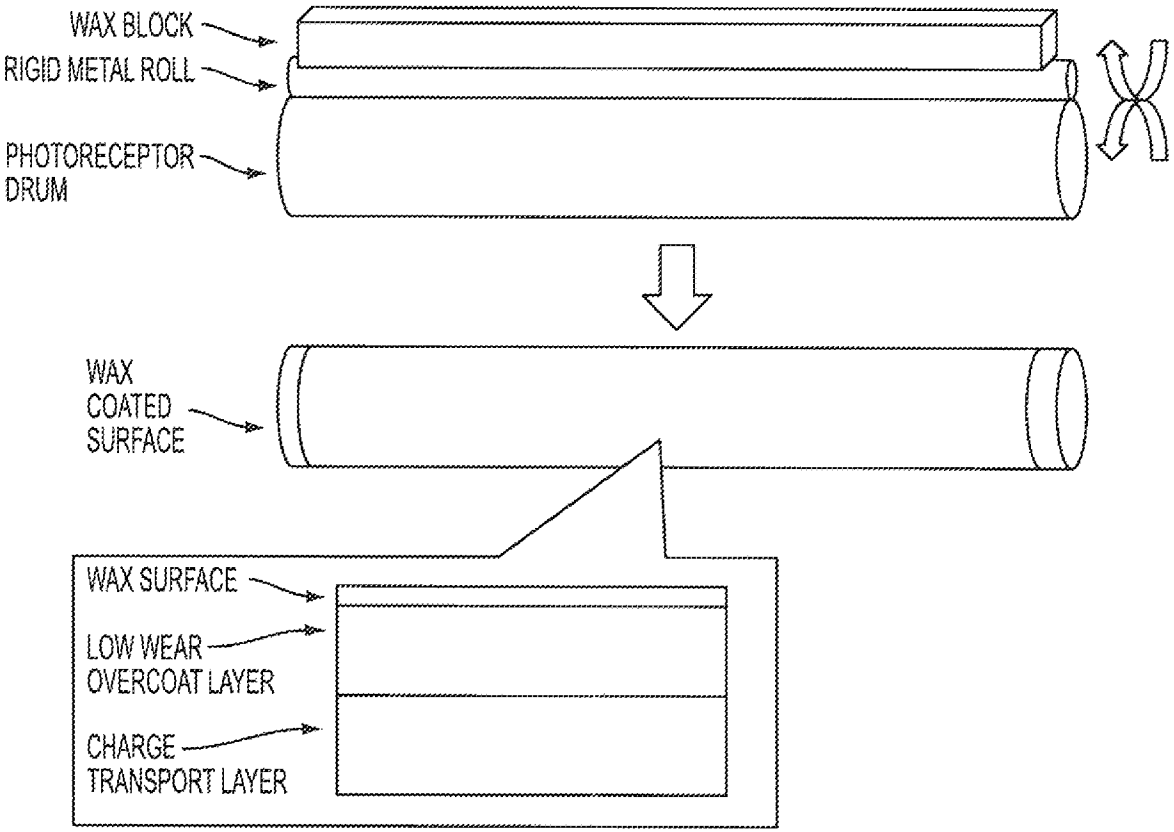
FIG. 2 depicts an apparatus for preparing an imaging member with a lubricant applied to its surface.

A photoreceptor was prepared having a low wear overcoat with thin wax layer applied over the overcoat. FIG. 2 is a representation of preparation of the photoreceptor of Comparative Example 2. A standard photoreceptor drum was dip coated with a polymeric anti-scratch overcoat (PASCO) overcoat layer. The PASCO overcoat was cured using a forced air oven at 155° C. for 40 minutes. A thin layer of polyethylene wax (X1197 from Baker Petrolite) was coated against the PASCO layer using a rigid rod application and a stationary block source. The rotation of the photoreceptor drum was maintained at 60 rpm or higher, forced air was maintained against the overcoat surface during application, and the temperature of overcoat layer surface was maintained at 100° C. during application of the wax.

Example 1

PTFE Block Source

Figure 3:
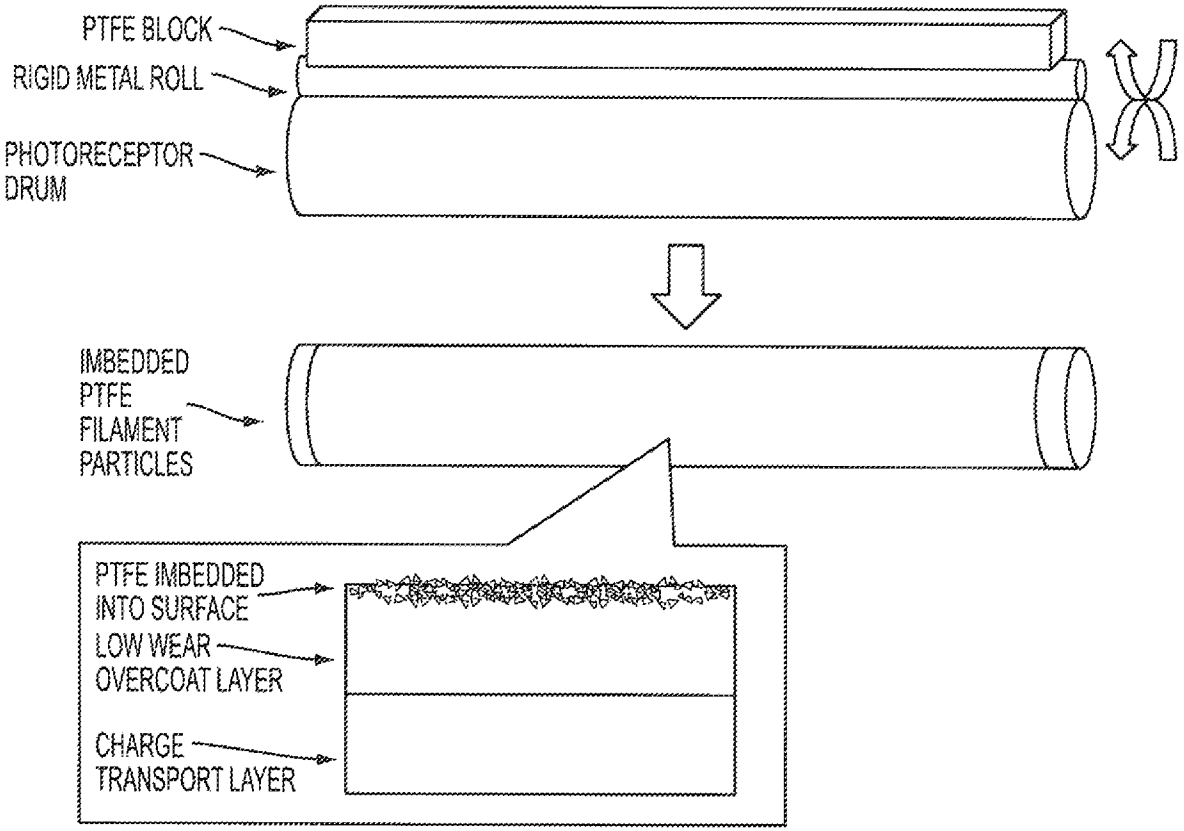
FIG. 3 depicts an apparatus for preparing an imaging member of some embodiments.

A photoreceptor was prepared having a low wear overcoat with polytetrafluoroethylene (PTFE) particles imbedded in the outer portion of the overcoat. FIG. 3 is a representation of preparation of the photoreceptor of inventive Example 1. A standard photoreceptor drum was dip coated with a polymeric anti-scratch overcoat (PASCO) overcoat layer. The PASCO overcoat dried at ambient conditions for between a minimum 5 minutes and a maximum of 10 minutes. PTFE particles were imbedded in the PASCO overcoat using a high pressure rigid rod against PASCO layer with a PTFE block source. An application roller scraped solid PTFE material from the PTFE block and applied the material to the overcoat with pressure. The PTFE particles were observed to have a wide distribution of size and shape. The rotation of the photoreceptor drum was maintained at 60 rpm or higher during imprinting with the PTFE particles, forced air was maintained against the overcoat surface during application, and the temperature of overcoat layer surface was maintained at 100° C. during imprinting. The PASCO overcoat layer with the imbedded PTFE particles was cured in an oven a 155° C. for 40 minutes.

Example 2

PTFE Particle Source

Figure 4:
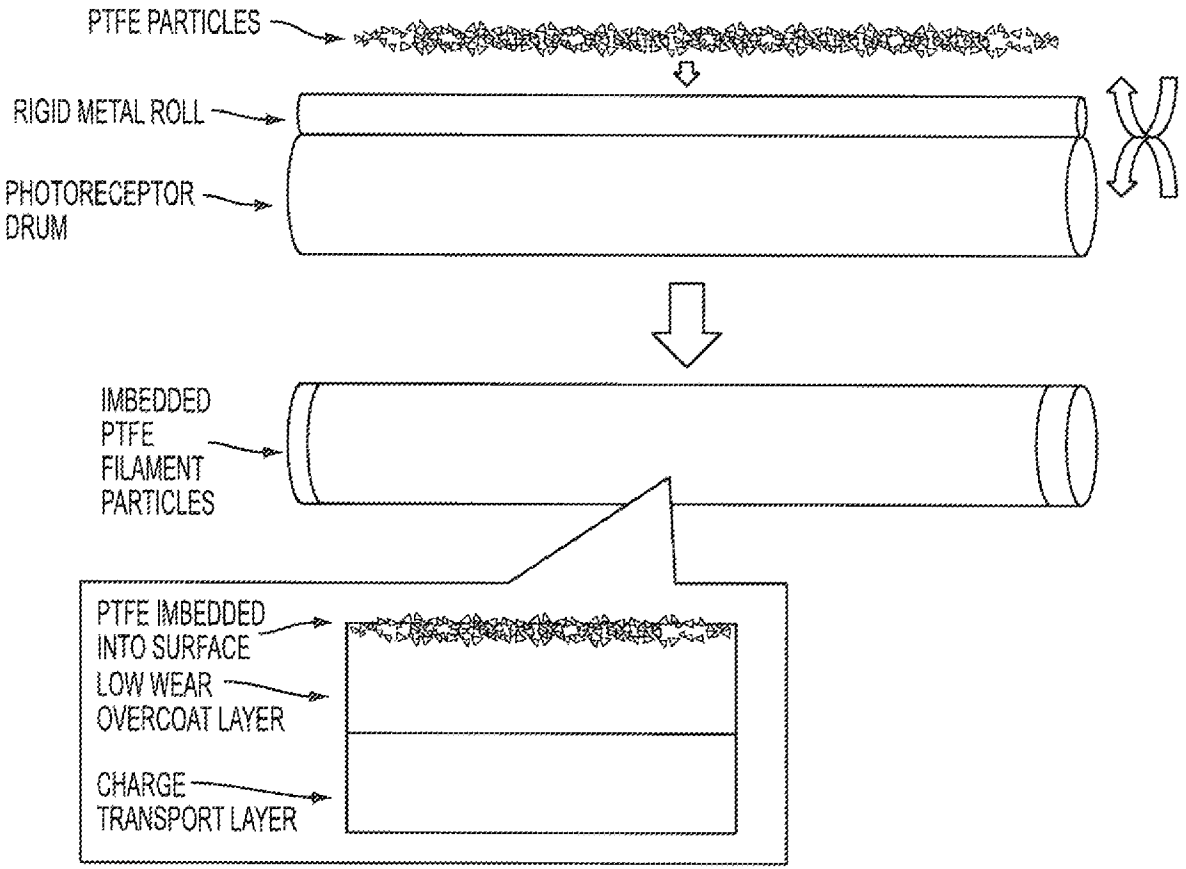
FIG. 4 depicts an apparatus for preparing an imaging member of certain embodiments.

A Photoreceptor is prepared having a low wear overcoat with PTFE particles imbedded in the overcoat surface. FIG. 4 is a representation of preparation of a photoreceptor of Example 2. A standard photoreceptor drum is dip coated with a polymeric anti-scratch overcoat (PASCO) overcoat layer. The PASCO overcoat is dried at ambient conditions for between a minimum 5 minutes and a maximum of 10 minutes. PTFE particles are imbedded in the PASCO overcoat using a high pressure rigid rod against PASCO layer with a PTFE particle source (as compared to the block source in Example 1). The fluoropolymer particle will have dimensions ranging from about 10 nm to about 10 μm. The rotation of the photoreceptor drum is maintained at 60 rpm or higher during imprinting with the PTFE particles, forced air is maintained against the overcoat surface during application, and the temperature of overcoat layer surface is maintained at 100° C. during imprinting. The PASCO overcoat layer with the imbedded PTFE particles is cured in an oven a 155° C. for 40 minutes.

Example 3

Results

Figure 5:
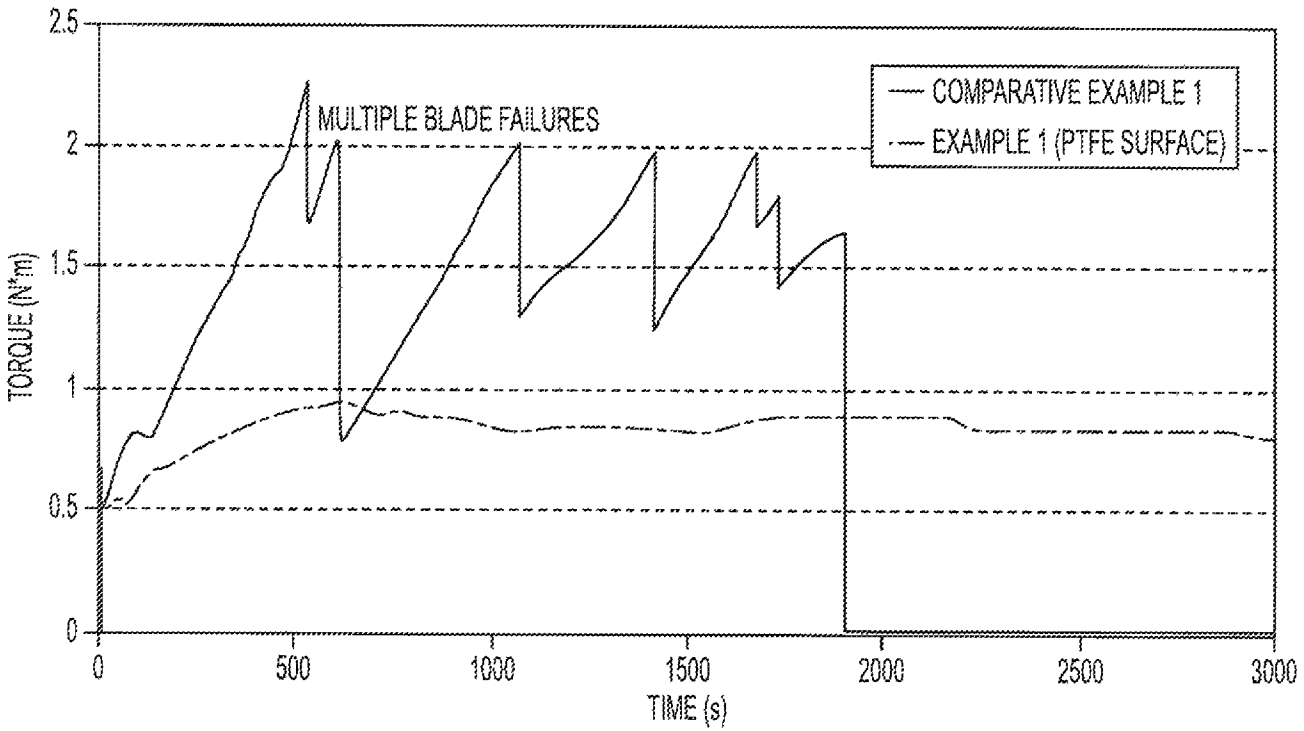
FIG. 5 is a graph of results of torque testing for a cleaning blade used with a conventional imaging member (with an overcoat and without added surface wax) and an imaging member of certain embodiments.

All examples and comparative examples were fabricated as discussed above (except for Example 2) and tested for torque in a surrogate fixture that simulates operation in a BCR (bias charge roller/primary charge roller) based 30 mm printer. The results for Comparative Example 1 and inventive Example 1 are shown in FIG. 5 as a graph of torque (N·m) vs. time (seconds). Without PTFE particles in the surface the torque can be so high the cleaning blade breaks apart and eventually completely fails. With PTFE particles imbedded into the surface, a dramatic improvement in, initial torque was observed. Due to blade conformation to the drum surface, the drum freely rotated even when the PTFE was visibly worn off after several thousand cycles.

Figure 6:
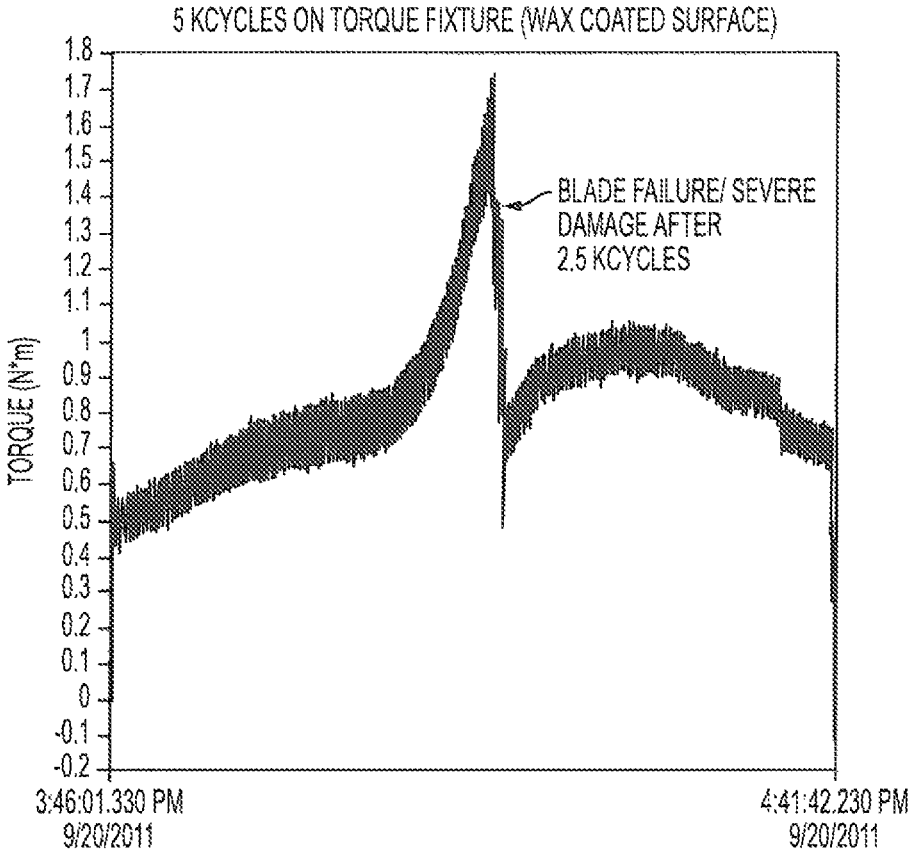
FIG. 6 is a graph for results of torque testing for a cleaning blade use with a conventional imaging member (with an overcoat and added surface wax).

Results for Comparative Example 2, demonstrated that when a lubricant such as wax was coated onto the overcoat surface it reduced the initial torque, but the blade eventually failed when the lubricant wore off. The results for Comparative Example 2 are shown in FIG. 6 as a graph of torque (N·m) vs. Kcycle. A surface lubricant did not enable blade conformation and only provided a transient benefit.

Example drums that had a thin layer of PTFE coated onto the surface were evaluated in a 30 mm UDS Series scanner and exhibited identical electrical characteristics to that of the comparative example with no PTFE bonded on the surface. The example drums were also print tested in an Oakmont printer (30 mm printer) and showed the same print performance as that of the comparative example although care had to be taken when coating so as not to damage the photosensitive layers as they showed up as severe print defects.

To the extent that the terms "containing," "including," "includes," "having," "has," "with," or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g., −1, −1.2, −1.89, −2, −2.5, −3, −10, −20, and −30, etc.

It will be appreciated that variants of the above-disclosed and other features and functions, or alternatives thereof, may be combined into many other different systems or applications. Various presently unforeseen or unanticipated alternative, modifications, variations or improvements therein may be subsequently made by those skilled in the art which are also intended to be encompassed by the following claims.

What is claimed is:

1. An imaging member comprising:

a support comprising an electrically conductive or semiconductive material, an imaging layer disposed on the support, an outermost layer disposed on the imaging layer, wherein the outermost layer has an outermost surface, and fluoropolymer particles imbedded only in the outermost surface of the outermost layer forming a thin outermost layer of embedded fluoropolymer particles, and serving as a sacrificial low surface energy layer, and wherein the thin outermost layer of the embedded fluoropolymer particles; is configured to be worn completely away after about 5,000 to about 10,000 prints.

2. The imaging member of claim 1, wherein the fluoropolymer particles comprise at least one of polytetrafluoroethylene (PTFE), a copolymer of tetrafluoroethylene (TFE) and hexafluoropropylene (HFP), a copolymer of hexafluoropropylene (HFP) and vinylidene fluoride (VDF), a copolymer of hexafluoropropylene (HFP) and vinylidene fluoride (VF2), a terpolymer of tetrafluoroethylene (TFE), vinylidene fluoride (VDF), and hexafluoropropylene (HFP), and a tetrapolymer of tetrafluoroethylene (TFE), vinylidene fluoride (VF2), and hexafluoropropylene (HFP).

3. The imaging member of claim 1, wherein the fluoropolymer particles comprises a polymer having at least a monomer repeat unit selected from the group consisting of tetrafluoroethylene, vinylidene fluoride, hexafluoropropylene, perfluoro(methyl vinyl ether), perfluoro(ethyl vinyl ether), and perfluoro(propyl vinyl ether), and mixtures thereof.

4. The imaging member of claim 1, wherein the fluoropolymer particles comprise polytetrafluoroethylene (PTFE).

5. The imaging member of claim 1, wherein the outermost layer is comprised of a cross-linked product obtained by curing and polymerizing a charge transport component comprised of a tertiary arylamine having at least a curable functional group selected from the group consisting of a hydroxyl, a hydroxymethyl, an alkoxymethyl, a hydroxyalkyl having from 1 to about 15 carbons, an acrylate, and mixtures thereof.

6. The imaging member of claim 5, wherein an additional curing agent is added for forming the cross-linked product and the curing agent is selected from the group consisting of a melamine-formaldehyde resin, a phenol resin, an isocyanate or a masking isocyanate compound, an acrylate resin, a polyol resin, and mixtures thereof.

7. The imaging member of claim 1, wherein the outermost layer comprises a curable composition, wherein the curable composition comprises a charge transport component and a curing agent.

8. The imaging member of claim 7, wherein the charge transport component comprises a tertiary amine having at least one curable functional group selected from the group consisting of a hydroxyl, a hydroxylmethyl, an alkoxymethyl, a hydroxyalkyl having from 1 to 15 carbons, an acrylate and mixtures of two or more thereof.

9. The imaging member of claim 7, wherein the curing agent is selected from the group consisting of melamine-formaldehyde resin, a phenol resin, an isocyalate or a masking isocyalate compound, an acrylate resin, a polyol resin, and mixtures of two or more thereof.

10. The imaging member of claim 1, wherein the fluoropolymer particles are present in an amount of from about 0.5% to about 30% by weight of total weight of the outermost layer.

11. The imaging member of claim 1, wherein the imaging layer has a multi-layered structure and comprises a charge generation layer disposed on the support, a charge transport layer disposed on the charge generation layer and the outermost layer disposed over the charge transport layer.

12. An image forming apparatus comprising:

an imaging member comprising a support, the support comprising an electrically conductive or semiconductive material, the imaging member further comprising an imaging layer formed on the support, wherein the imaging member comprises an outermost layer having an outermost surface and fluoropolymer particles imbedded only in the outermost surface of the outer layer forming a thin outermost layer of embedded fluoropolymer particles, and serving as a sacrificial low surface energy layer, and wherein the thin outermost layer of the embedded fluoropolymer particles; is configured to be worn completely away after about 5,000 to about 10,000 prints;

a charging unit that applies electrostatic charge on the imaging member;

a developing unit that develops a toner image onto the imaging member;

a transfer unit that transfers the toner image from the imaging member to a media; and a cleaning unit that cleans the imaging member, wherein the imaging member has an about 10% to about 90% reduction in torque as compared to a control imaging member comprising an outermost layer without the fluoropolymer particles when the image forming apparatus is operated.

13. A process for preparing an imaging member comprising:

coating an imaging layer with an outer layer formulation, wherein the imaging layer is disposed on a support comprising an electrically conductive or semiconductive material;

drying the outer layer formulation to form an outer layer disposed on the imaging layer having an outer surface; and applying fluoropolymer particles to the outer layer thereby imbedding the fluoropolymer particles in the outer surface.

14. The process of claim 13, wherein the application of the fluoropolymer particles comprises bonding the fluoropolymer particles to the outer layer.

15. The process of claim 13, further comprising curing the outer layer having the imbedded fluoropolymer particles.

16. The process of claim 13, wherein fluoropolymer particles are applied to the outer layer with a rigid rod and a block fluoropolymer source.

17. The process of claim 13, wherein fluoropolymer particles are applied to the outer layer with a rigid rod and a fluoropolymer particle source.

18. A method of making an imaging member comprising:

pressing fluoropolymer particles into an outermost layer coated on a photosensitive substrate to form a thin outermost layer of imbedded fluoropolymer particles, wherein the photosensitive substrate comprises at least an imaging layer disposed under the outermost layer, the imaging layer disposed on a support comprising an electrically conductive or semiconductive material; and curing the outermost layer, wherein the fluoropolymer particles are imbedded only in the outermost surface of the outermost layer forming a thin outermost layer of embedded fluoropolymer particles, and serving as a sacrificial low surface energy layer, and wherein the thin outermost layer of the embedded fluoropolymer particles is configured to be worn completely away after about 5,000 to about 10,000 prints.

* * * * *